US006062748A

United States Patent [19]

Shimizu et al.

[11] Patent Number: 6,062,748

[45] Date of Patent: May 16, 2000

[54] STAMP LOGOTYPE PRINTING APPARATUS

[75] Inventors: Toshiya Shimizu, Shiki-gun; Takashi Takamoto, Sakurai, both of Japan

[73] Assignee: Sharp Kabushiki Kaisha, Osaka, Japan

[21] Appl. No.: 09/003,241

[22] Filed: Jan. 6, 1998

[30] Foreign Application Priority Data

Jan. 6, 1997 [JP] Japan ..... P9-000204

[51] Int. Cl.[7] ..... B41J 3/42

[52] U.S. Cl. ..... 400/70; 400/582; 400/621

[58] Field of Search ..... 400/61, 70, 76, 400/593, 621, 582

[56] References Cited

U.S. PATENT DOCUMENTS

| | | | |
|---|---|---|---|
| 4,312,597 | 1/1982 | Shimizu et al. | 400/621 |
| 4,348,125 | 9/1982 | Fujiwara et al. | 400/645.1 |
| 4,417,517 | 11/1983 | Matsuda et al. | 400/605 |

FOREIGN PATENT DOCUMENTS

| | | |
|---|---|---|
| 1-159790 | 6/1989 | Japan . |
| 4-363787 | 12/1992 | Japan . |
| 7-182565 | 7/1995 | Japan . |
| 2 072 102 | 9/1981 | United Kingdom . |

OTHER PUBLICATIONS

Copy of European Search Report.

*Primary Examiner*—John S. Hilten

*Attorney, Agent, or Firm*—David G. Conlin; David A. Tucker; Dike, Bronstein, Roberts & Cushman, LLP

[57] ABSTRACT

In case of printing a stamp logotype in a constitution in which a distance from a printing position to a cutting position is relatively short, it is designed to prevent useless space from being formed at the top region of a receipt and to appropriate relatively wide area for a stamp logotype printing region. A printer controller controls a head and a cutter so that, when a length of the stamp logotype is longer than a distance L from the printing position of the head to the cutting position of the cutter, the image of the stamp logotype is divided into a first logotype A equal to the distance L and a remaining second logotype B, so as to have the logotype A printed on the receipt before a preceding receipt is cut, and the logotype B printed on the receipt after the preceding receipt is cut.

6 Claims, 10 Drawing Sheets

STAMP LOGOTYPE PRINTING APPARATUS

BACKGROUND OF THE INVENTION

1. Field of the Invention

The present invention relates to a stamp logotype printing apparatus for printing stamp logotypes such as trade name, telephone number, commercial message, etc. on a receipt in case of issuing receipts by a printer in an ECR (Electronic Cash Register) or a POS (Point of Sale) system, more specifically to a stamp logotype printing apparatus having a mechanism to cut a receipt sheet.

2. Description of the Related Art

With respect to the prior art of the kind, as shown in Japanese Unexamined Patent Publication JP-A 7-182565 (1995), there is known a method for memorizing print data of a stamp logotype in division into an image data section and a character data section, with the object of improving a printing processing speed and facilitating an alteration of contents of the character section in the stamp logotype.

With respect to other prior art example, as shown in Japanese Unexamined Patent Publication JP-A 1-159790 (1989), there is known a method wherein, in order to shorten the time for issuing a receipt, after the final printing on the receipt, the sheet is long-fed by a distance corresponding to a stamp logotype region, cut, and then provided with stamp logotype printing or commercial printing.

Furthermore, as to other prior art, as shown in Japanese Unexamined Patent Publication JP-A 4-363787 (1992), there is known a method wherein, in order to shorten the time for issuing a receipt, in an ECR equipped with a thermal printer, fixed header information such as images like a stamp logotype, messages, is printed lay registering first one of articles purchased by the customer.

FIG. 2 shows a head/printing mechanism of general thermal printer, wherein a receipt paper P to be transferred by a roller 21 is cut by a cutter 23 after it is printed by a thermal head 22. And, in case a distance L from a printing position by the thermal head 22 to a cut position by the cutter 23 is relatively short, when a stamp logotype is printed on a next receipt after cutting a preceding receipt as shown in FIG. 12A, there is a problem to provide a useless space of distance L before a printing stamp logotype region. On the contrary, when the preceding receipt is cut after printing the stamp logotype on the next receipt as shown in FIG. 12B, because of the necessity to cut the preceding receipt before the top portion of the printed stamp logotype reaches the cut position, there is a problem to make the stamp logotype printing region very narrow.

SUMMARY OF THE INVENTION

In view of the problematic points of the prior art as described above, an object of the present invention is to provide a stamp logotype printing apparatus, in which, in case of printing a stamp logotype in a constitution that the distance from the printing position to the cutting position is relatively short, it is possible to prevent useless space from being formed at the top end portion of the receipt and to appropriate relatively wide area to stamp logotype printing region.

A first stamp logotype printing apparatus comprises, in order to attain the above object, a head for carrying out printing on a receipt, a cutter for cutting the receipt at the downstream of a printing position of the head, and control means for controlling the head and the cutter so that, when a length of a stamp logotype is longer than a distance from the printing position of the head to a cutting position of the cutter, an image of the stamp logotype is divided into a first region having a length approximately equal to the above distance and a second region of the remaining part, so as to have the first region of the stamp logotype image printed on the receipt before a preceding receipt is cut, and the second region of the stamp logotype image printed on the receipt after the preceding receipt is cut.

A second stamp logotype printing apparatus comprises, in order to attain the above object, a head for carrying out printing on a receipt, a cutter for cutting the receipt at the downstream of a printing position of the head, and control means for controlling the head and the cutter so that, when a length of a stamp logotype is longer than a distance from the printing position of the head to a cutting position of the cutter, an image of the stamp logotype is divided into a first region and a second region by a blank line as a border in the image of the stamp logotype, so as to have the first region of the stamp logotype image printed on the receipt before a preceding receipt is cut, and the second region of the stamp logotype image printed on the receipt after the preceding receipt is cut.

A third stamp logotype printing apparatus comprises, in order to attain the above object, a head for carrying out printing on a receipt, a cutter for cutting the receipt at the downstream of a printing position of the head, and control means for controlling the head and the cutter so that, when a length of a stamp logotype is longer than a distance from the printing position of the head to a cutting position of the cutter, an image of the stamp logotype is divided into a first region and a second region by a blank line as a border in the image of the stamp logotype, as well as magnified or reduced, so as to have the first region of the stamp logotype image printed on the receipt before a preceding receipt is cut, and the second region of the stamp logotype image printed on the receipt after the preceding receipt is cut.

A fourth stamp logotype printing apparatus comprises, in order to attain the above object, a head for carrying out printing on a receipt, a cutter for cutting the receipt at the downstream of a printing position of the head, and control means for controlling the head and the cutter so that, when a length of a stamp logotype is longer than a distance from the printing position of the head to a cutting position of the cutter, an image of the stamp logotype is divided into a first region and a second region by a line having large proportion of blanks as a border in the image of the stamp logotype, so as to have the first region of the stamp logotype image printed on a current receipt before a preceding receipt is cut, and the second region of the stamp logotype image printed on the current receipt after the preceding receipt is cut.

A fifth stamp logotype printing apparatus comprises, in order to attain the above object, a head for carrying out printing on a receipt, a cutter for cutting the receipt at the downstream of a printing position of the head, and control means for controlling the head and the cutter so that, when a length of a stamp logotype is longer than a distance from the printing position of the head to a cutting position of the cutter, an image of the stamp logotype is divided into a first region and a second region by a line having large proportion of blanks as a border in the image of the stamp logotype, as well as magnified or reduced, so as to have the first region of the stamp logotype image printed on the receipt before a preceding receipt is cut, and the second region of the stamp logotype image printed on the receipt after the preceding receipt is cut.

The sixth invention is characterized in that the control means according to the first to the fifth inventions controls so that the divided regions of the image of the stamp logotype are memorized in different buffers and printed in accordance with respective printing commands.

According to the first invention, when the length of the stamp logotype is longer than the distance from the printing position to the cutting position, the image of the stamp logotype is divided into the first region having the length approximately equal to the above distance and the second region of the remaining part for printing. Accordingly, it is possible to prevent useless space from being formed at the top region of the receipt and to appropriate wide area to stamp logotype printing region.

According to the second invention, when the length of the stamp logotype is longer than the distance from the printing position to the cutting position, the stamp logotype is divided into the first region and the second region bordered by the blank line in the images of the stamp logotype for printing. Accordingly, it is possible to prevent useless space from being formed at the top region of the receipt and to appropriate wide area to stamp logotype printing region.

According to the third invention, when the length of the stamp logotype is longer than the distance from the printing position to the cutting position, the stamp logotype is divided into the first region and the second region bordered by the blank line in the image of the stamp logotype, and magnified or reduced for printing. Accordingly, it is possible to prevent useless space from being formed at the top region of the receipt and to appropriate wide area to stamp logotype printing region.

According to the fourth invention, when the length of the stamp logotype is longer than the distance from the printing position to the cutting position, the stamp logotype is divided into the first region and the second region bordered by the line having large proportion of blanks in the image of the stamp logotype for printing. Accordingly, it is possible to prevent useless space from being formed at the top region of the receipt and to appropriate wide area to stamp logotype printing region.

According to the fifth invention, when the length of the stamp logotype is longer than the distance from the printing position to the cutting position, the stamp logotype is divided into the first region and the second region bordered by the line having large proportion of blanks in the images of the stamp logotype, and magnified or reduced for printing. Accordingly, it is possible to prevent useless space from being formed at the top region of the receipt and to appropriate wide area to stamp logotype printing region.

According to the sixth invention, printing is performed by the individual printing commands based on the images of the divided stamp logotypes memorized in the different buffers. Therefore, the freedom in printing can be improved, and the contents of the receipt following the stamp logotype can be printed in continuation.

In the fourth and fifth inventions, it is desirable for the stamp logotype to be divided into the first region and the second region bordered by the line having the largest proportion of blanks in the images of the stamp logotype.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
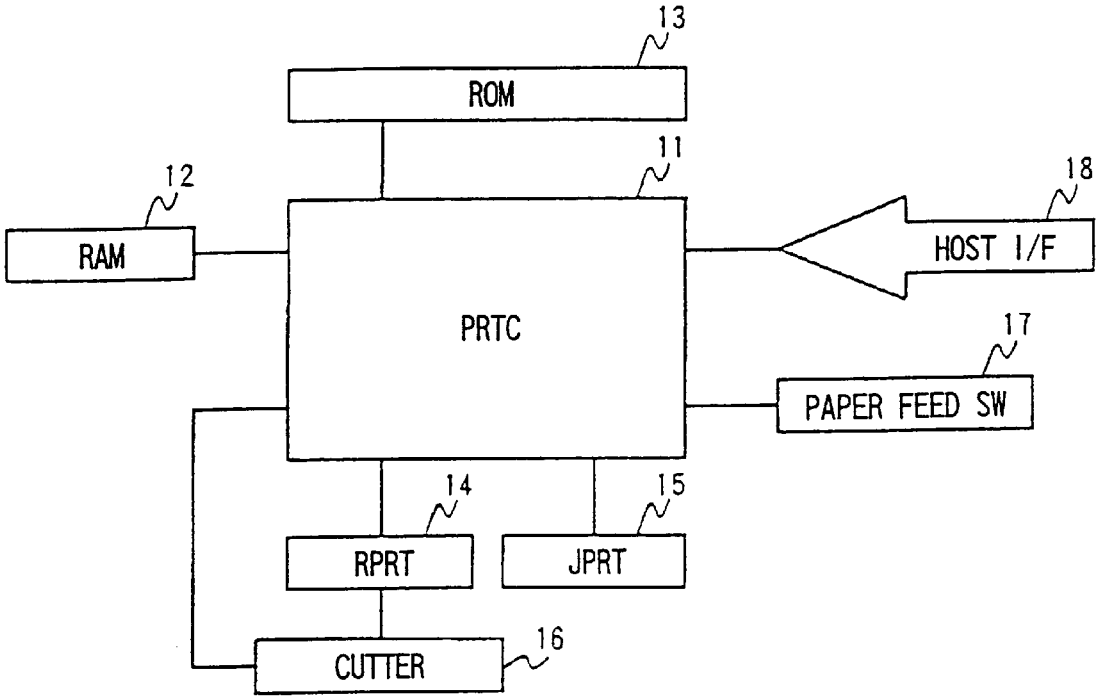
FIG. 1 is a block diagram showing a control system of a first embodiment of a stamp logotype printing apparatus according to the invention.

Now referring to the drawings, preferred embodiments of the invention are described below.

Figure 2:
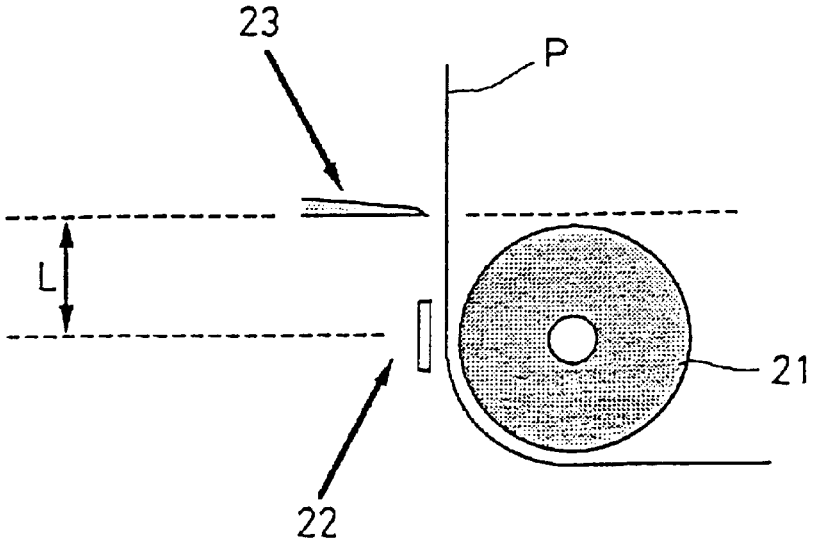
FIG. 2 is a constitution view showing a printing/cutting section of the stamp logotype printing apparatus of FIG. 1.
Figure 3:
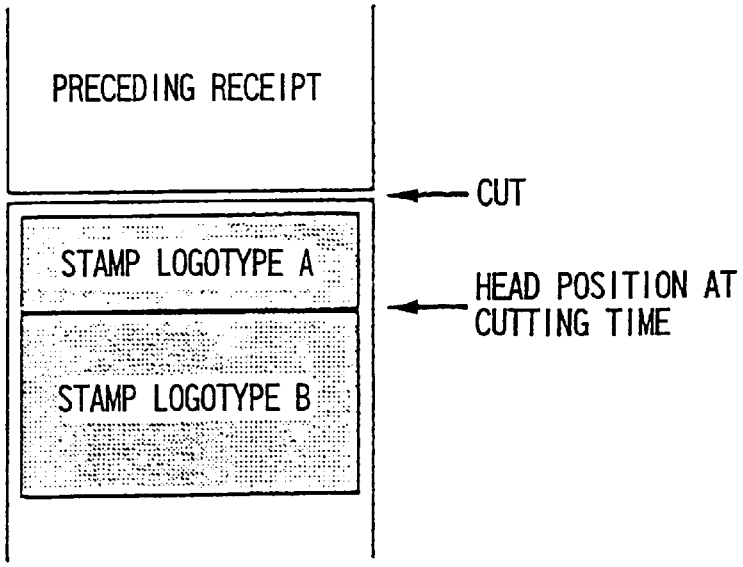
FIG. 3 is an explanatory view showing a stamp logotype printed by the stamp logotype printing apparatus of FIG. 1.
Figure 4:
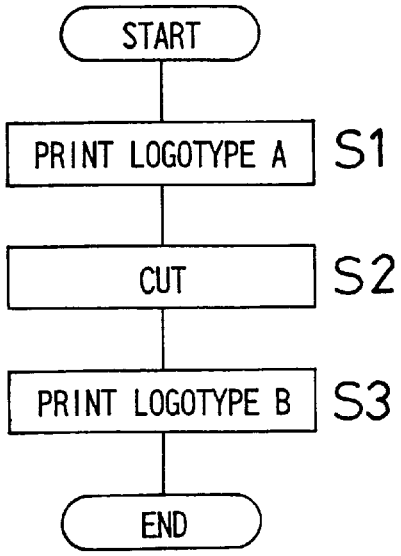
FIG. 4 is a flow chart explaining processes of the stamp logotype printing apparatus of FIG. 1.

FIG. 1 is a block diagram showing a control system of a first embodiment of a stamp logotype printing apparatus according to the invention; FIG. 2 is a constitution view showing a printing/cutting section of the stamp logotype printing apparatus of FIG. 1; FIG. 3 is an explanatory view showing a stamp logotype printed by the stamp logotype printing apparatus of FIG. 1; FIG. 4 is a flow chart for explaining processes of the stamp logotype printing apparatus of FIG. 1; and FIG. 5 is a flow chart showing in detail the print processing of the stamp logotype A of FIG. 4.

The stamp logotype printing apparatus shown in FIG. 1 comprises a printer controller (PRTC) 11 for carrying out control of a whole printer, a RAM 12 for memorizing various set data, various buffers, counters and plugs, etc., a ROM 13 to constitute a character generator of the printer, a receipt printer (RPRT) 14 having a roller 21, a thermal head 22, etc. for carrying out printing on a receipt P as shown in FIG. 2, a journal printer (JPRT) 15 for printing a journal, a cutter section 16 having a cutter 23 for cutting the receipt as shown in FIG. 2, a paper feed switch (SW) 17 for designating the paper feed of the receipt printer 14 and the journal printer 15, and a host interface (I/F) 18 for receiving data from a host.

In the invention, as shown in FIG. 3, the stamp logo is divided into two regions A and B, and as shown in the flow chart of FIG. 4, after printing a stamp logotype A on a receipt, a preceding receipt is cut (step S1→S2), after which the stamp logotype B is printed on the receipt (step S2→S3). Here, the printings of the stamp logotype A and the stamp logotype B are carried out in accordance with different commands, and image data of the stamp logotype A and image data of the stamp logotype B are memorized in different buffer areas on the RAM 12.

Figure 5:
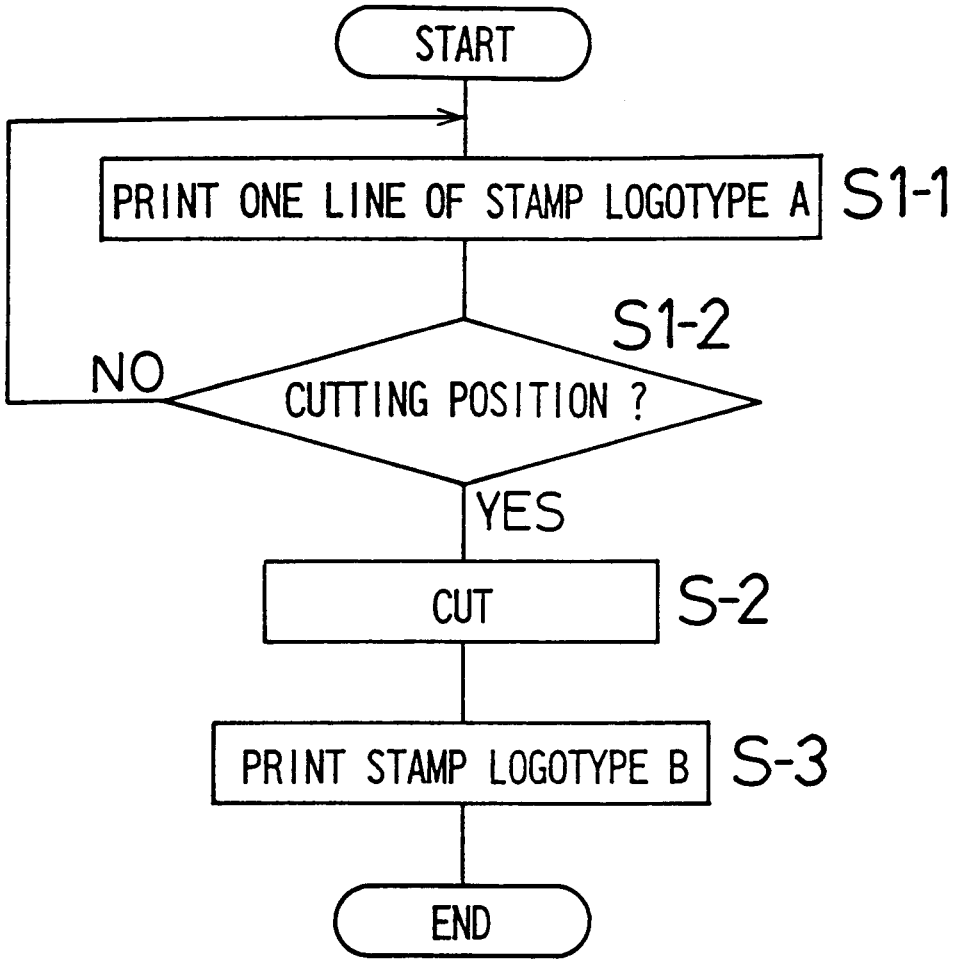
FIG. 5 is a flow chart showing in detail the print process of the stamp logotype A of FIG. 4.

In a printing process for the stamp logotype A in step S1 in FIG. 4, as shown in detail in FIG. 5, when one line portion of the stamp logotype A is printed (step S1-1), whether it is on a cutting position or not is checked(step S1-2), and if it is not on the cutting position, step returns to step S1-1 to print next one line portion of the stamp logotype A, and if it is judged to be the cut position in step S1-2, then the sequence advances to step S2 to cut the preceding receipt.

FIGS. 6 are explanatory views showing positions to divide the stamp logotype. The numerals shown in FIGS. 6 are as follows:

AD, AD1, AD2: Distance from top end of receipt to top end of stamp logotype A BD, BD1, BD2: print distance of stamp logotype A CD, CD1, CD2: print distance of stamp logotype B DD: receipt width ED: print width of stamp logotypes A,B FD: width of left side margin of stamp logotypes A,B GD: width of right side margin of stamp logotypes A,B, and a distance L from the thermal head 22 to the cutter 23 is AD+BD.

Figure 6A:
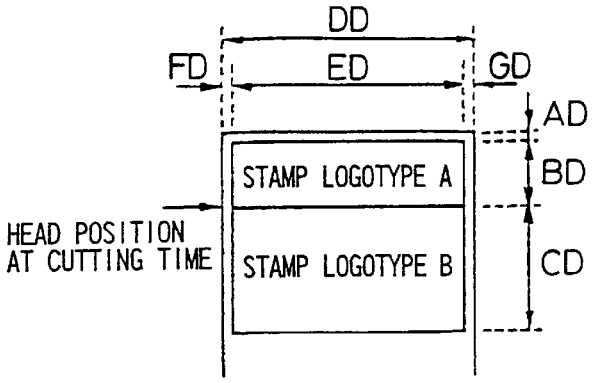
FIGS. 6A, 6B, 6C, 6D and 6E are explanatory views showing positions to divide the stamp logotype.
Figure 6B:
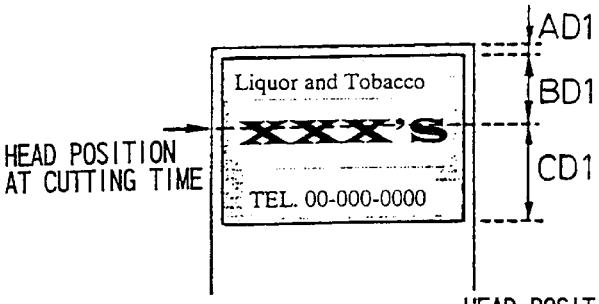

As a comparative example, the stamp logotype image shown in FIG. 6B comprises three lines of "Liquor and Tobacco" of first line, "XXX'S" of second line, and "TEL. 00-000-0000" of third line. It indicates that, when divided at the position of the distance AD1+BD1 from the top end of the receipt, the half-way part of the image "XXX'S" on the second line comes to be the divisional position. As another comparative example, the stamp logotype image shown in FIG. 6C comprises three lines of "XXX'S" of first line, "Liquor and Tobacco" of second line, and "TEL. 00-000-0000" of third line. It indicates that, when divided at the position of the distance AD1+BD1 from the top end of the receipt, the half-way part of the image "XXX'S" of first line comes to be the divisional position. Consequently, when printing is started at the position of the distance AD1 from the top end of the receipt, division is made at the half-way part of the image "XXX'S", so that, if the printing is re-started under such a state, disturbance of images such as blank of one line portion may occur.

Figure 6D:
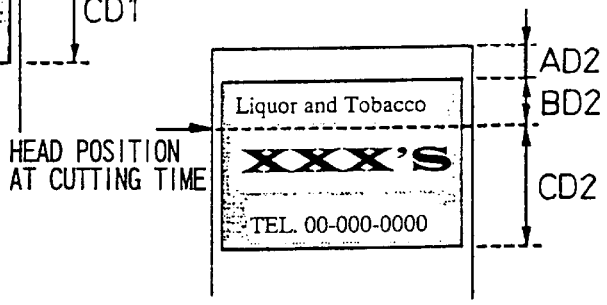
Figure 7:
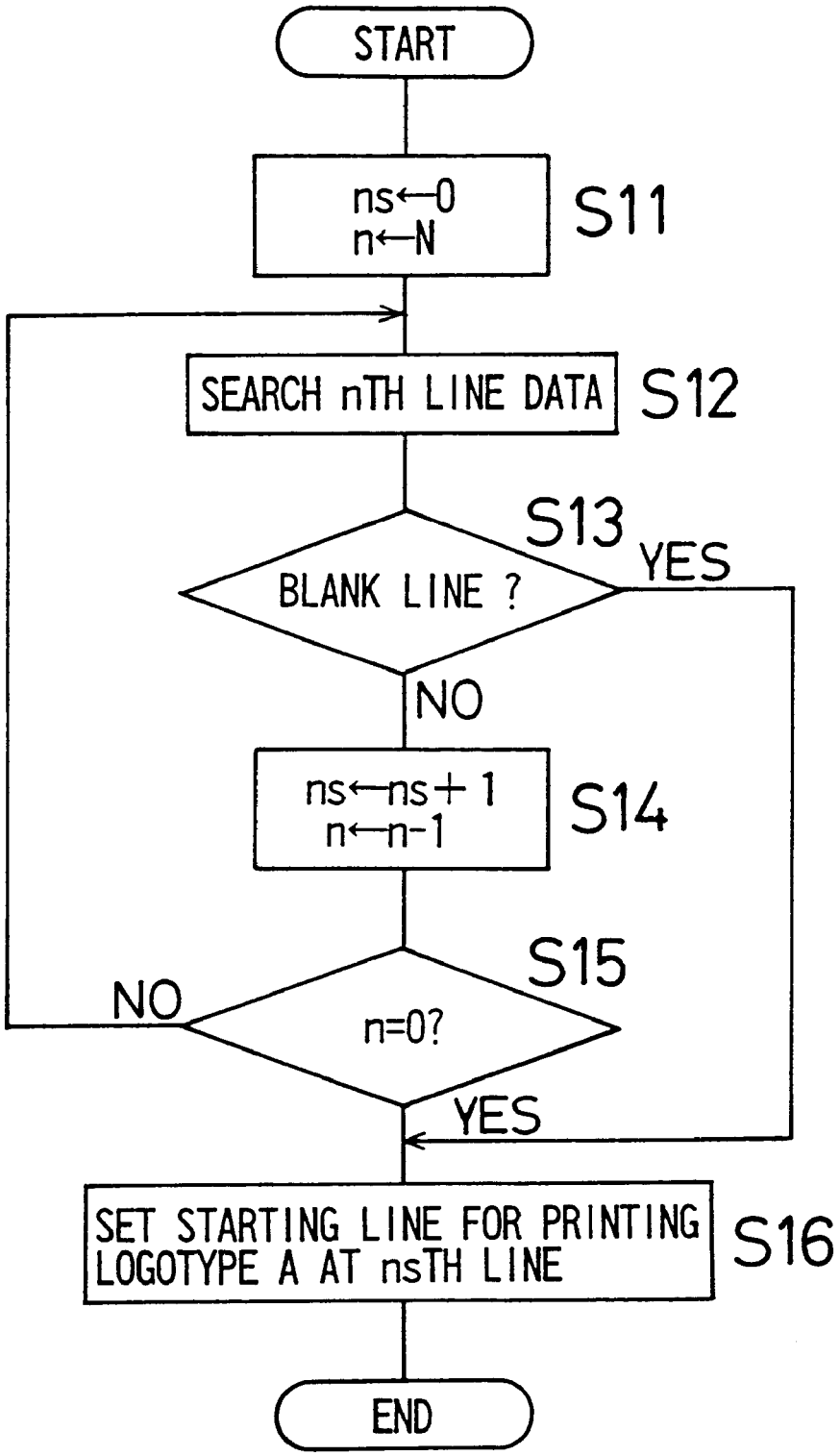
FIG. 7 is a flow chart for explaining a setting process of a stamp logotype printing position in a second embodiment.
Figure 8:
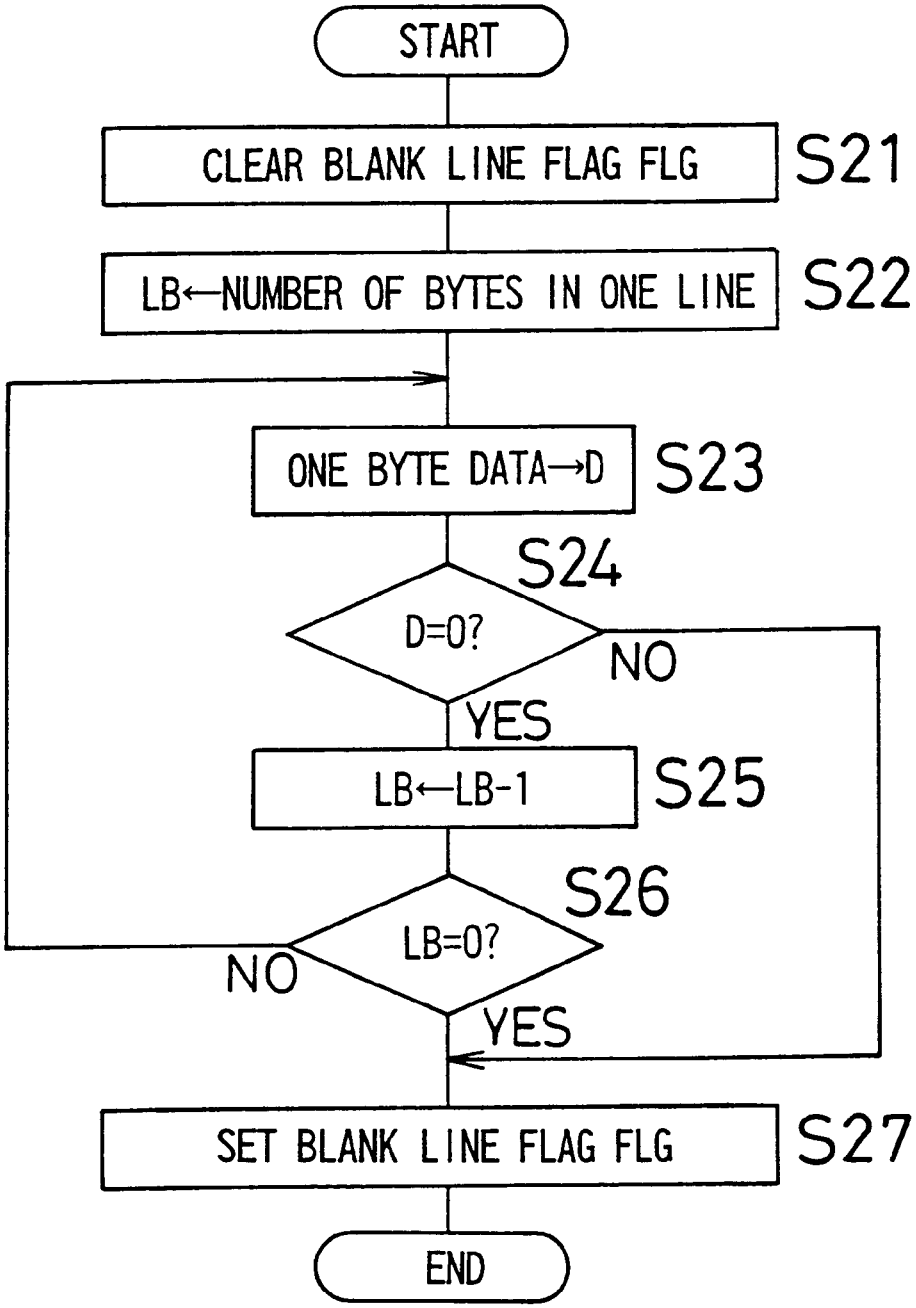
FIG. 8 is a flow chart showing in detail the n-line data search process in FIG. 7 and FIG. 9.

Accordingly, in the second embodiment of the invention as shown in the flow charts of FIGS. 7 and 8, as shown in FIG. 6D, there is so constituted as to prevent occurrence of the blank caused by dividing the half-way part of the image, by shifting the print starting position of the stamp logotype to the distance AD2 from the top end of the receipt.

The parameters in FIG. 7 are as follows:

ns: counter indicating the position of a line at which printing of the stamp logotype A is started;

n: counter for searching a blank line in the stamp logotype image data; and

N: value indicating number of lines from printing position to the cutting position.

At first, the counter ns is cleared to "0" and the counter n is set at an initial value N(step S11), then search the nth line in the stamp logotype image data by the processing shown in detail in FIG. 8 (step S12). To explain in detail the processing of step S12 for searching the nth line in the stamp logotype image data by referring to FIG. 8, at first, a blank line flag FLG is cleared (step S21), and then set a register LB at byte number in one line (step S22). Next, one byte data in LBth byte is gotten and a register D is set at the one byte (step S23). Then, judgment is made as to whether the register D is set at the value "0" or not (step S24).

And, unless the state is D=0, the line is not the blank line, in which case the processing is terminated. On the contrary, in case of D=0, the register LB is subjected to decrement by one (step S25). In case the register LB is "0", the sequence returns to step S23. On the other hand, in case of LB=0, a blank line flag FLG is set (step S27) to terminate the processing. Reverting to FIG. 7, the program judges whether the nth line is a blank line or not (step S13), and in case it is a blank line, the sequence advances to step S16, while in case it is not blank line, the value of the counter ns is incremented by one, and the value of the counter n is decremented by one(step S14). Next, whether n=0 or not is judged(step S15), and in case of not being n=0, the sequence returns to step S12 to search the nth line, while on the other hand in case of n=0, the sequence advances to step S16 and sets the starting line of the stamp logotype printing at the nsth line.

Consequently, according to this second embodiment, in case of the stamp logotype image in which the half-way part of the image "XXX'S" on the second line comes to be the divisional position as shown in FIG. 6B, the stamp logotype print starting position of shifts to change the distance AD1 to the distance AD2 so as to make the intermediate position between the "Liquor and Tobacco" of the first line and the "XXX'S" of the second line to be the divisional position. Therefore, such occurrence, as division at the half-way part of the image "XXX'S" of the second line to produce disturbance of images can be prevented. In this case, the whole size of the stamp logotype does not vary but the relation becomes (BD1+CD1)=(BD2+CD2).

Figure 6C:
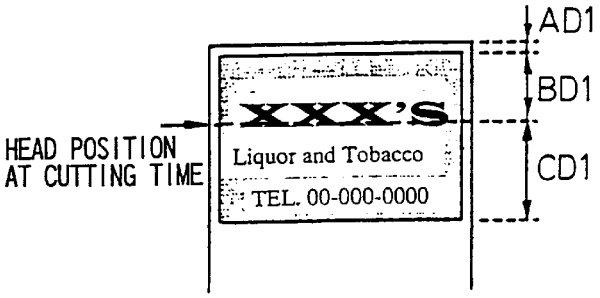
Figure 6E:
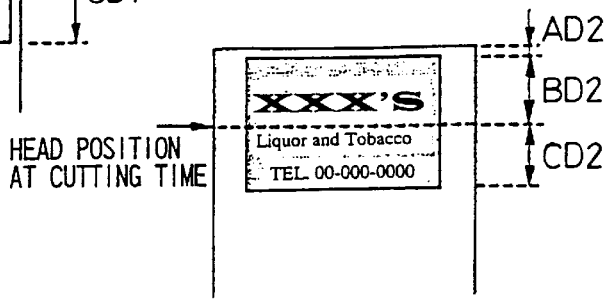
Figure 9:
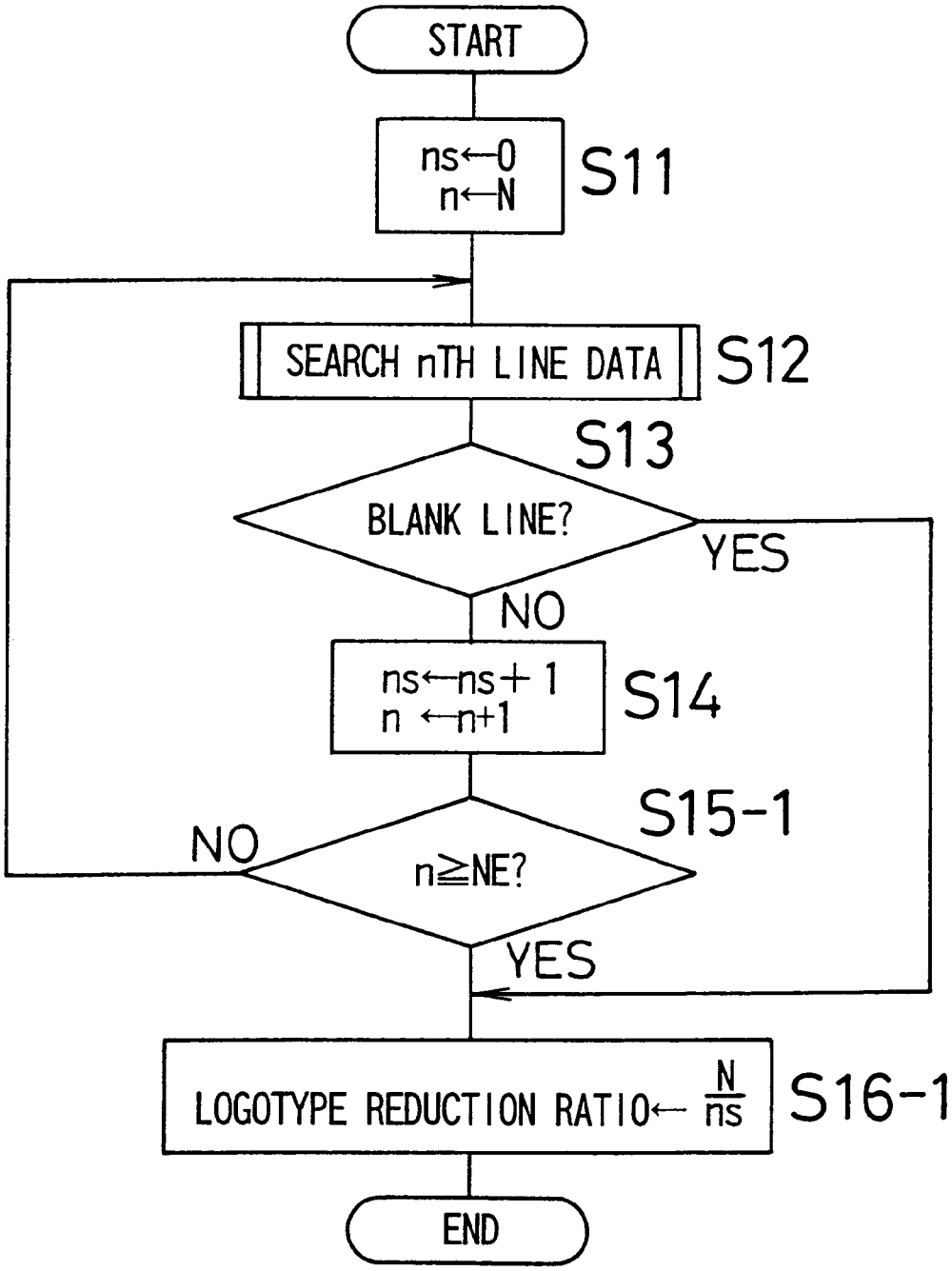
FIG. 9 is a flow chart for explaining a setting process of a stamp logotype printing magnification in a third embodiment.

According to the third embodiment of the invention shown in the flow chart of FIG. 9, there is such constitution that, as shown in FIG. 6E, the stamp logotype image is reduced to prevent a blank area from being formed under division of half-way part of the image. Since the process of step S12 is same as the process of the second embodiment shown in FIG. 8, the explanation thereon is omitted.

The steps S11 to S14 shown in FIG. 9 are the same as those shown in FIG. 7. NE is a total number of the printing lines of the stamp logotype. In step S15-1, check is made whether n≧NE or not, and in case of n≧NE, the sequence advances to step S16-1 to set the reduction ratio of the stamp logotype at N/ns. On the other hand, in case of the relation not being n≧NE, the sequence returns to step S12 to search the nth line data again.

Consequently, according to this third embodiment, in case of the stamp logotype image in which the half-way part of the image "XXX'S" of the first line comes to be the divisional position as shown in FIG. 6C, the image is reduced to make the intermediate position between the "XXX'S" of the first line and the "Liquor and Tobacco" of the second line to be the divisional position, as shown in FIG. 6E. Therefore, such occurrence that an image is divided at the half-way part to produce image disturbance can be prevented. In this case, the print starting position does not change (AD2=AD1) but the whole stamp logotype is reduced to (BD2+CD2)/(BD1+CD1).

In the second and third embodiments, the blank line in the image is determined as the divisional position, but depending on the stamp logotype image, the blank line does not necessarily exist. Therefore, in the fourth embodiment of the invention, the line having small number of printing data dots, i.e., large blank space, is selected as a divisional position to make the trace of division less conspicuous.

Figure 10:
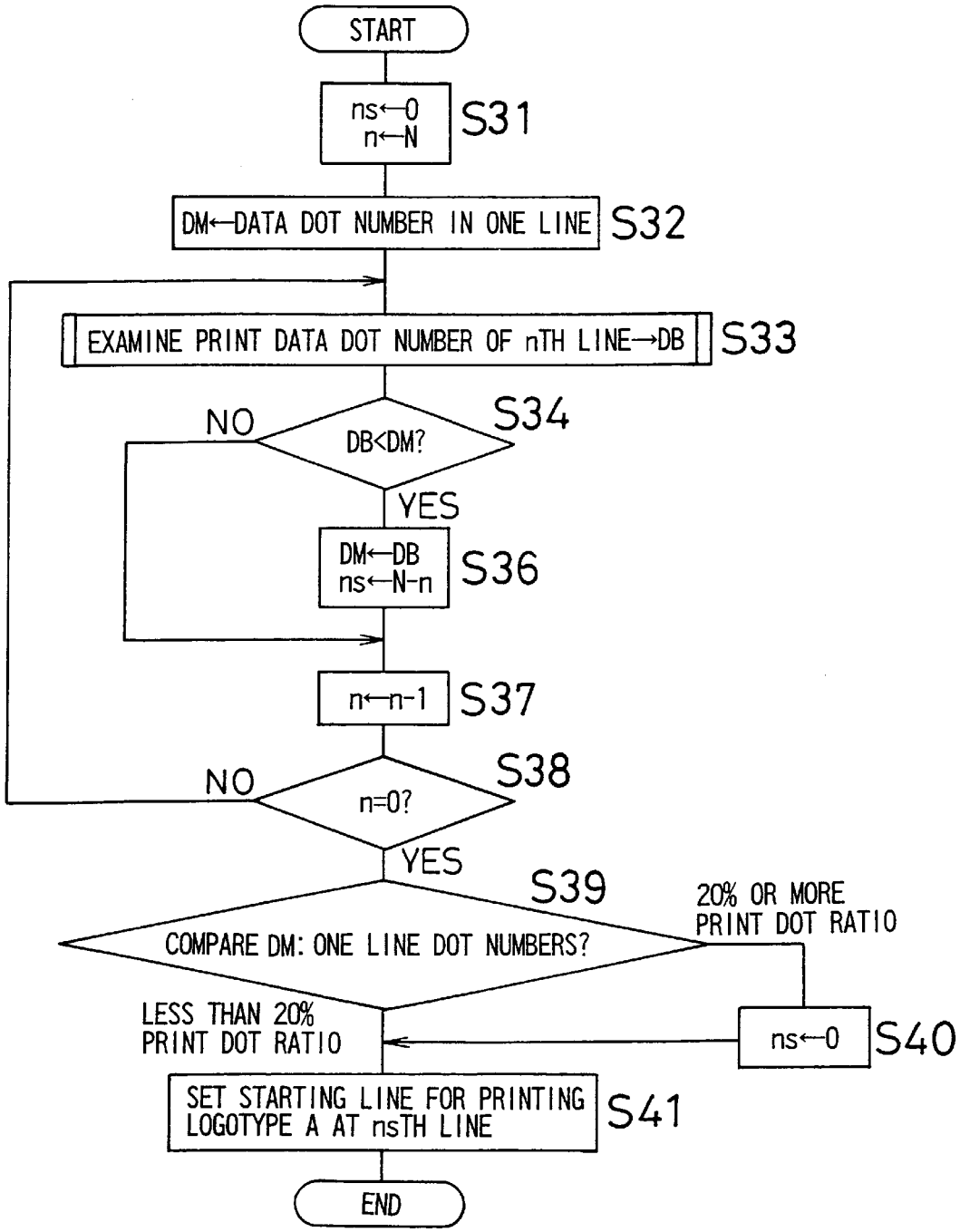
FIG. 10 is a flow chart for explaining a setting process of a stamp logotype printing position in a fourth embodiment.

Referring to the flow charts of FIGS. 10 and 11, the fourth embodiment is explained below. At first, the counter ns is cleared to "0", and set the counter n at initial value N (step S31). Next, a register DM is set at data dot number in one line (data dot number of stamp logotype in horizontal direction)(step S32), and then a dot number of the printing data on the nth line is examined by the processing shown in detail in FIG. 11 and set a register DB at the resulting value(step S33).

Figure 11:
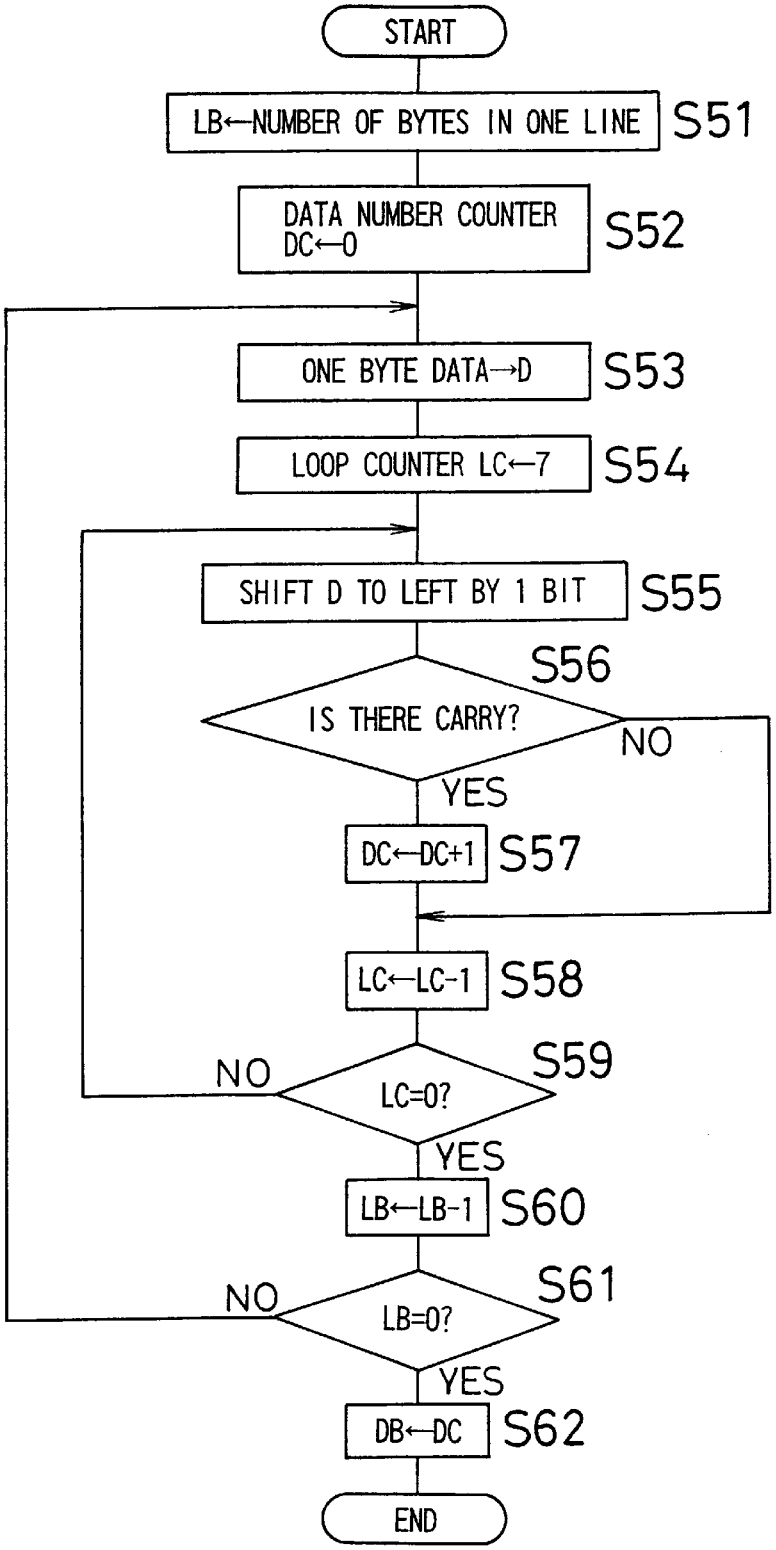
FIG. 11 is a flow chart showing in detail the processing to examine the dot number of the printing data in FIG. 10.
Figure 12A:
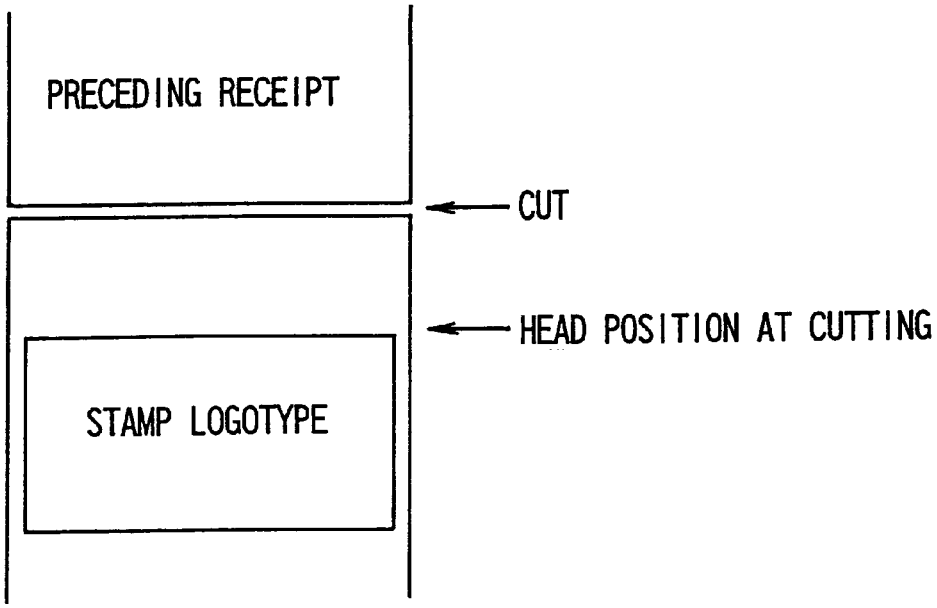
FIGS. 12A and 12B are an explanatory view showing a conventional stamp logotype printing processing.
Figure 12B:
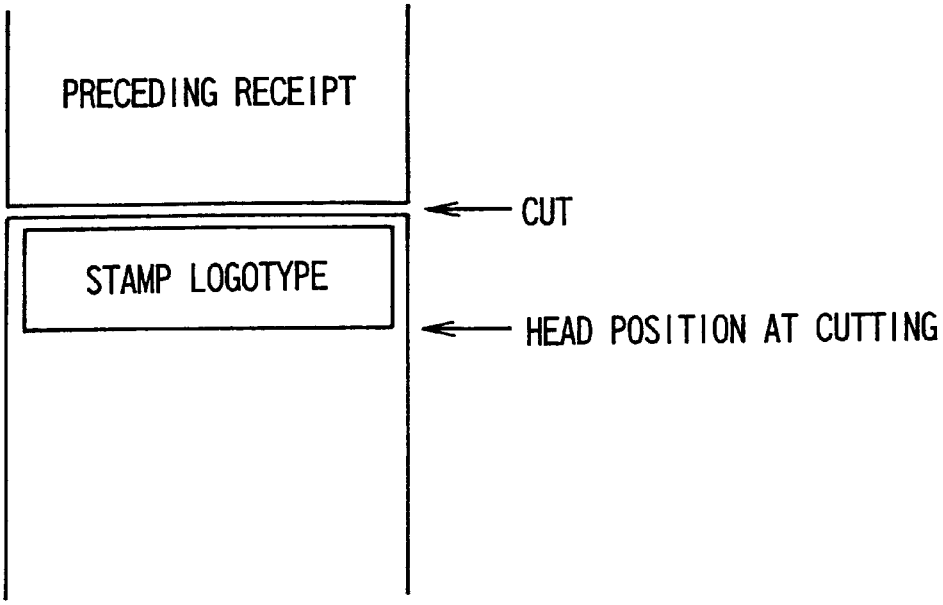

In FIG. 11, the register LB is set at the number of bytes in a line(step S51), and a data number counter DC is cleared (DC←0) (step S52). Next, then one byte data is gotten and the register D is set at the one byte data (step S53), and a loop counter LC is set at "7" (step S54). Following this, the data in the register D is shifted to left by 1 bit(step S55), and next presence or absense of a carry is judged (step S56).

And, if there is a carry, in step S57, the value of the data number counter DC is incremented by one to advance to step S58. If there is no carry, the sequence advances to step S58 as it is. In step S58, after the loop counter LC is subjected to decrement by one, the loop counter LC value is judged (step S59), and if it is not LC=0, the sequence returns to step S55, while on the other hand, in case of LC=0, the sequence advances to step S60. In step S60, after the value of the register LB is subjected to decrement by one, the value of the register LB is judged (step S61), and if it is not LB=0, the sequence returns to step S53, while on the other hand, in case of LC=0, after the register DB is set at the value of the data number counter DC(step S62), the processing is terminated. Returning to FIG. 10, the register DB and the register sount DM are compared (step S34). And, if the result of the comparison is not DB<DM, the sequence advances to step S37, while if the result is DB<DM, the register DM is set at the value of the register DB and the value of (N−n) to the counter ns (step S36), and then the the value of the counter n is decremented by one (step S37).

Next, the value of the counter n is judged (step S38). In case the value is not n=0, the sequence returns to step S33, while in the case of n=0, the register DM and the dot number of printing data in a first line are compared (step S39). And, in case the value of the register DM is less than, for example, 20% of the dot number of the printing data in the first line, the sequence advances to step S41 to set the print starting line of the stamp logotype at the value of the couter ns. On the other hand, in the judgment of step S39, in case the value of the register DM is equal to or more than, for example, 20% of more of the data dot number of the first line, since there is scarce effect to change the print starting line of the stamp logotype, the sequence advances to step S40 and initializes the counter ns to zero, followed by advancing to step S41.

Consequently, according to the fourth embodiment, in case of the stamp logotype image in which the half-way part of the image becomes the divisional position, the line having large blank space is selected as a divisional position, so that it is possible to make the trace of division less conspicuous.

The method of selecting the line having large blank space as a divisional line can of course be combined with the method of magnifying or reducing the stamp logotype image as explained with reference to FIG. 6E.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A stamp logotype printing apparatus comprising:

a head for carrying out printing on a receipt;

a cutter for cutting the receipt at the downstream of a printing position of the head; and control means for controlling the head and the cutter so that, when a length of a stamp logotype is longer than a distance from the printing position of the head to a cutting position of the cutter, an image of the stamp logotype is divided into a first region having a length approximately equal to the above distance and a second region of the remaining part, so as to have the first region of the stamp logotype image printed on the receipt before a preceding receipt is cut, and the second region of the stamp logotype image printed on the receipt after the preceding receipt is cut.

2. A stamp logotype printing apparatus comprising:

a head for carrying out printing on a receipt;

a cutter for cutting the receipt at the downstream of a printing position of the head; and control means for controlling the head and the cutter so that, when a length of a stamp logotype is longer than a distance from the printing position of the head to a cutting position of the cutter, an image of the stamp logotype is divided into a first region and a second region by a blank line as a border in the image of the stamp logotype, so as to have the first region of the stamp logotype image printed on the receipt before a preceding receipt is cut, and the second region of the stamp logotype image printed on the receipt after the preceding receipt is cut.

3. A stamp logotype printing apparatus comprising:

a head for carrying out printing on a receipt;

a cutter for cutting the receipt at the downstream of a printing position of the head; and control means for controlling the head and the cutter so that, when a length of a stamp logotype is longer than a distance from the printing position of the head to a cutting position of the cutter, an image of the stamp logotype is divided into a first region and a second region by a blank line as a border in the image of the stamp logotype, as well as magnified or reduced, so as to have the first region of the stamp logotype image printed on the receipt before a preceding receipt is cut, and the second region of the stamp logotype image printed on the receipt after the preceding receipt is cut.

4. A stamp logotype printing apparatus comprising:

a head for carrying out printing on a receipt;

a cutter for cutting the receipt at the downstream of a printing position of the head; and control means for controlling the head and the cutter so that, when a length of a stamp logotype is longer than a distance from the printing position of the head to a cutting position of the cutter, an image of the stamp logotype is divided into a first region and a second region by a line having large proportion of blanks as a border in the image of the stamp logotype, so as to have the first region of the stamp logotype image printed on the receipt before a preceding receipt is cut, and the second region of the stamp logotype image printed on the receipt after the preceding receipt is cut.

5. A stamp logotype printing apparatus comprising:

a head for carrying out printing on a receipt;

a cutter for cutting the receipt at the downstream of a printing position of the head; and control means for controlling the head and the cutter so that, when a length of a stamp logotype is longer than a distance from the printing position of the head to a cutting position of the cutter, an image of the stamp logotype is divided into a first region and a second region by a line having large proportion of blanks as a border in the image of the stamp logotype, as well as magnified or reduced, so as to have the first region of the stamp logotype image printed on the receipt before a preceding receipt is cut, and the second region of the stamp logotype image printed on the receipt after the preceding receipt is cut.

6. The stamp logotype printing apparatus of any one of claims 1 to 5, wherein the control means controls so that the divided regions of the image of the stamp logotype are memorized in different buffers and printed in accordance with respective printing commands.

* * * * *